United States Patent [19]

Wallis

[11] 4,311,429

[45] Jan. 19, 1982

[54] WORKPIECE TRANSFER MECHANISM

[76] Inventor: Bernard J. Wallis, 25200 Trowbridge Ave., Dearborn, Mich. 48124

[21] Appl. No.: 137,370

[22] Filed: Apr. 4, 1980

[51] Int. Cl.[3] ..... B21D 43/05

[52] U.S. Cl. ..... 414/750; 72/421; 74/30; 198/621

[58] Field of Search ..... 414/749–751, 414/222, 225; 198/621, 740, 741; 72/405, 421; 100/207; 280/254; 74/29, 30, 89.17, 109, 110

[56] References Cited

U.S. PATENT DOCUMENTS

| | | | |
|---|---|---|---|
| 3,148,571 | 9/1964 | Wallis | 100/207 X |
| 3,165,192 | 1/1965 | Wallis | 414/750 X |
| 3,653,293 | 4/1972 | Wallis | 414/749 X |
| 3,707,908 | 1/1973 | Merk et al. | 100/207 |
| 3,754,667 | 8/1973 | Storch | 414/751 X |
| 3,756,425 | 9/1973 | Wallis | 414/750 |
| 3,939,992 | 2/1976 | Mikulec | 414/750 |
| 4,182,203 | 1/1980 | Drury | 74/30 X |
| 4,198,845 | 4/1980 | Sofy | 198/621 X |

*Primary Examiner*—Leslie J. Paperner
*Assistant Examiner*—Terrance L. Siemens
*Attorney, Agent, or Firm*—Barnes, Kisselle, Raisch & Choate

[57] ABSTRACT

A gear rack pivotally mounted on the ram of a metal working press extends downwardly at an angle to the vertical in driving relation with a laterally offset drive gear on a device for transferring workpieces to successive stations in the press.

8 Claims, 6 Drawing Figures

WORKPIECE TRANSFER MECHANISM

This invention relates to a transfer mechanism and, more specifically, to a transfer device for progressively indexing workpieces between successive stations of a die mounted in a press.

Many transfer devices of the general type to which the present invention relates have been heretofore proposed. They normally include a pair of finger bars which are actuated by a suitable mechanism to produce a walking beam motion in either a vertical or horizontal plane. The finger bars are normally provided with longitudinally spaced work gripping elements which move in a rectangular path, first inwardly to grip the workpiece, then forwardly to advance the workpiece through a desired transfer distance, then outwardly to release the workpiece, and, finally, rearwardly back to the starting position. Many such transfer devices are operated by a vertically extending gear rack on the press ram so that the complete cycle of the finger bars is generated by a full up and down stroke of the ram.

However, such transfer devices and the die assembly used therewith are periodically removed from a press and stored to enable production of a different workpiece on the press. The storage of such transfer devices with vertical gear racks frequently presents a space problem because the vertical gear rack projects either upwardly above or downwardly below the die with which it is assembled.

Accordingly, it is an object of this invention to provide a transfer mechanism of the type driven by a press ram through a gear rack designed such that it can be stored or stacked as a very compact unit.

More specifically, the object of this invention is to provide a transfer mechanism of the type described wherein the gear rack is mounted for pivotal movement about the horizontal axis of the drive gear so that, after it is disconnected from the press ram, it can be rotated to a horizontally extending position for storage purposes.

Another object of the invention is to provide a transfer device adapted to be driven from the press ram by a gear rack which is caused to both pivot and shift axially in response to vertical reciprocation of the press ram.

Other objects, features and advantages of the present invention will become apparent from the following description and accompanying drawings, in which.

While the invention is adaptable to numerous types of ram operated transfer devices where a generally walking beam motion is imparted to the finger bar, for the purpose of illustration the invention is disclosed herein on a transfer device of the type illustrated in my prior U.S. Pat. No. 3,756,425, dated Sept. 4, 1973. Except for the differences in the main gear rack drive arrangement, the construction and operation of the disclosed finger bar assembly and its associated components are essentially the same as disclosed in my said prior patent.

Figure 1:
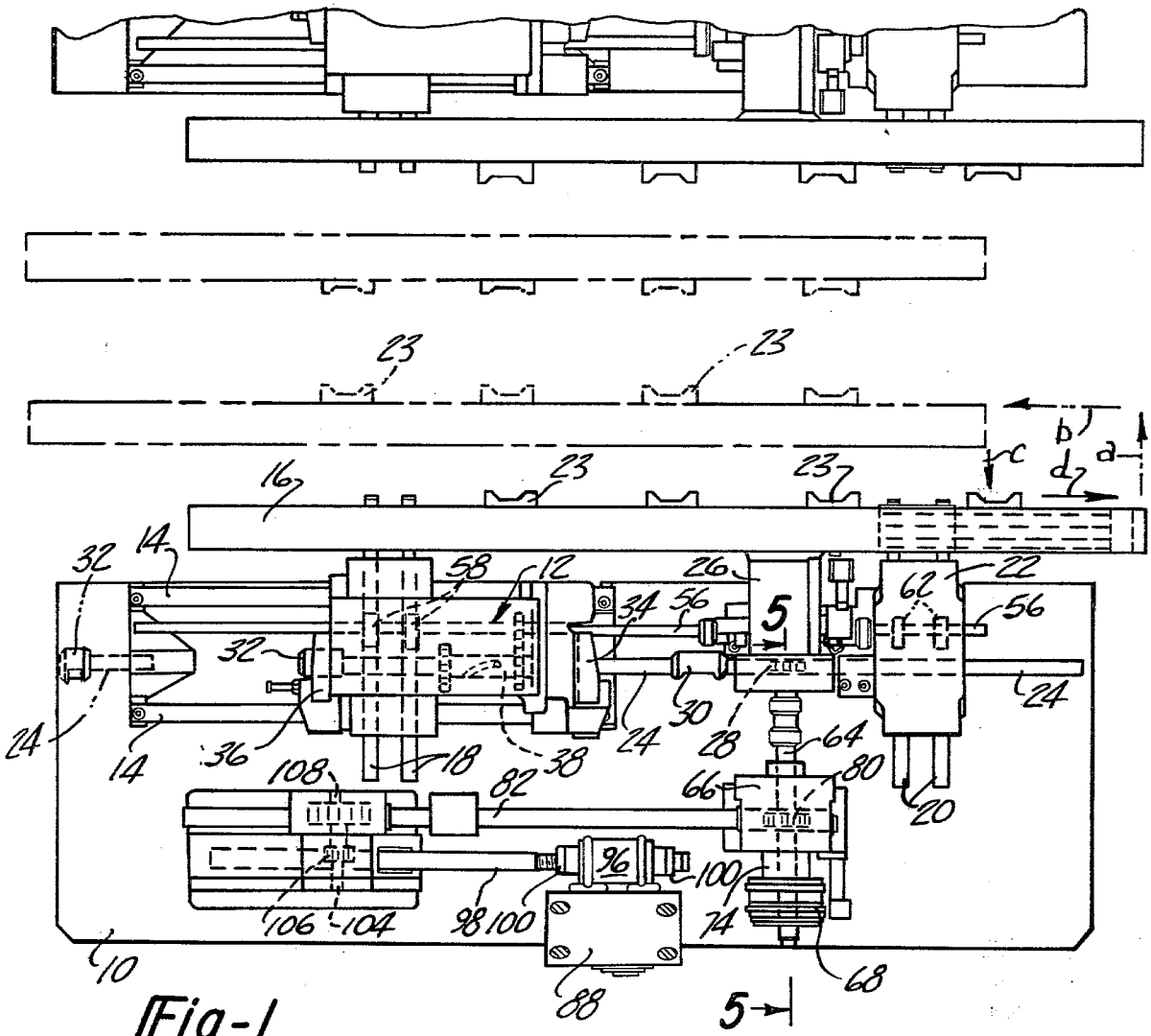
FIG. 1 is a fragmentary plan view of a transfer mechanism embodying the present invention.

Referring to FIG. 1, the transfer mechanism generally includes a base plate 10 on which a carriage 12 is mounted for sliding movement in a longitudinal direction by means of a pair of guide bars 14. A finger bar 16 is supported adjacent one end on carriage 12 by means of transversely shiftable finger bar rods 18. Adjacent its opposite end finger bar 16 is slideably supported on finger bar rods 20 which are adapted to be reciprocated within a housing 22 in a direction transverse to the path of travel of carriage 12. In the condition shown in FIG. 1 both the carriage 12 and the finger bar 16 are illustrated in their retracted positions. Also as shown in FIG. 1, a similar transfer mechanism is located in the press on the opposite side of the transfer mechanism fully illustrated and the die with the successive stations therein (not illustrated) is located between the two opposed transfer bars.

The drive for the transfer mechanism is designed to produce a generally rectangular walking beam motion in a horizontal plane of the two transfer bars. More specifically, with the transfer bars in the retracted position shown in FIG. 1 they are first moved laterally inwardly toward each other to grip the workpiece as indicated by the letter a. Thereafter the carriage 12 is advanced in a direction to the left so that the transfer bars while gripping the workpieces are displaced to the left as indicated by the arrow b. The stroke of carriage 12 corresponds to the spacing between the work gripping fingers 23. The workpieces are thus indexed one station through the die. After being so indexed the transfer bars are retracted laterally outwardly in the direction of the arrow c and then returned to their starting position by the carriage 12 as indicated by the arrow d. These successive movements of the finger bar 16 are controlled primarily by an axially shiftable actuator 24. Actuator 24 comprises a shaft which is supported for axial sliding movement within carriage 12, housing 22 and an additional housing 26. The portion of actuator 24 extending through housing 26 is formed as a gear rack which meshes with a gear 28 which is adapted to be rotated in opposite directions to reciprocate the actuator. A pair of carriage drive bushings 30,32 are fixedly secured to actuator 24 to reciprocate therewith. The drive bushings 32 are spaced apart lengthwise of actuator 24 a distance substantially greater than the length of carriage 12. At each end thereof carriage 12 is provided with a latch mechanism 34,36 adapted for interengagement with and release by the drive bushings 30,32, respectively. The operation of the drive bushings 30,32 and the latch mechanisms 34,36 is described in detail in my aforesaid earlier patent. In general, this arrangement is such that when the actuator 24 is shifted to the left from the position shown in FIG. 1 carriage 12 remains latched in the position illustrated until drive bushing 30 engages and releases the right end latch mechanism 34 on the carriage. Thereafter, carriage 12 is displaced with the actuator 24 on the guide bars 14 through a predetermined stroke. When carriage 12 is in the fully advanced position and actuator 24 is shifted axially to the right, the carriage remains latched in its advanced position until the drive bushing 32 engages and releases the latch mechanism 36 at the left end of the carriage 12 and, thereafter, the carriage is retracted back to its starting position shown in FIG. 1.

Figure 6:
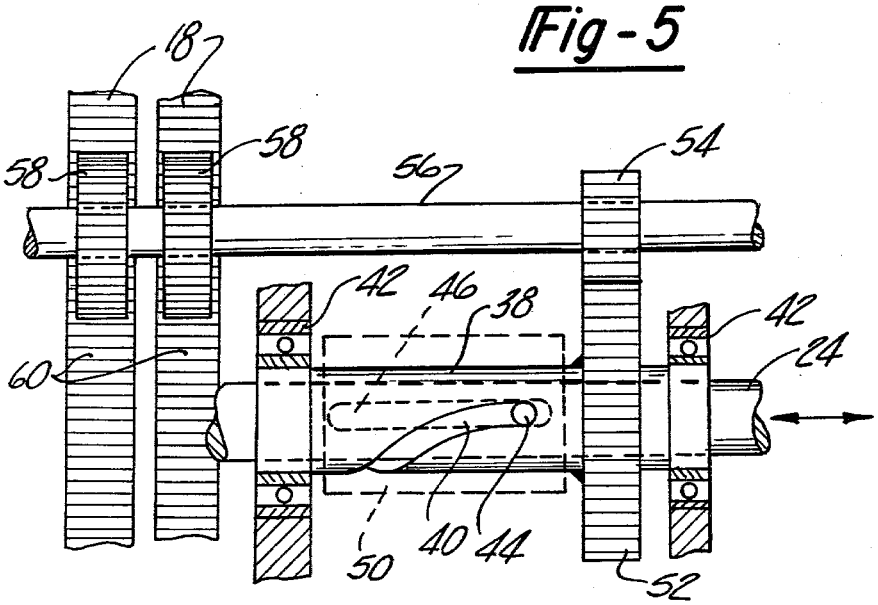
FIG. 6 is a fragmentary sectional view of the carriage and finger bar drive of the transfer device.

Referring now to FIG. 6, the operation of the finger bar rods 18 will be described. Within the carriage 12 there is arranged on actuator 24 a sleeve 38 having a longitudinally extending spiral slot 40 therein. Sleeve 38 is journalled within carriage 12 by bearings 42 which are designed to prevent axial displacement of the sleeve on the carriage. A pin 44 on actuator 24 extends through spiral slot 40 and also through an axially extending straight slot 46 formed in a plate 50 fixedly secured within carriage 12. The straight slot 46 prevents actuator 24 from rotating as it is reciprocated axially and the pin 44 engaging spiral slot 40 causes sleeve 38 to oscillate about the axis of actuator 24 in response to reciprocation of actuator 24. A gear 52 keyed to sleeve 38 meshes with another gear 54 in carriage 12 splined to a shaft 56. Shaft 56 is fixedly journalled in housing 22 and extends through carriage 12 so that the carriage is adapted to slide axially of shaft 56. Gear 54 is splined to shaft 56 and journalled in carriage 12 so that it remains in engagement with gear 52 as carriage 12 reciprocates. Within housing 12 there is similarly splined on shaft 56 a pair of gears 58 which mesh with gear rack portions 60 on finger bar rods 18. Within housing 22 a pair of additional gears 62 are keyed to shaft 56 and mesh with gear rack portions on finger bar rods 20.

With the above described arrangement, when the actuator 24 is displaced axially to the left relative to carriage 12, sleeve 38 is rotated and through the gears 52,54,58 the finger bar rods 18 and finger bar 16 are displaced laterally inwardly to the broken line position shown in FIG. 1. At the same time, the finger bar rods 20 are similarly displaced. When actuator 24 is displaced axially in a direction toward the right relative to carriage 12, sleeve 38 is rotated in the opposite direction and the finger bar 16 is displaced from the broken line position to the retracted position shown in solid lines in FIG. 1. Thus, a complete cycle of the transfer mechanism is obtained when actuator 24 is reciprocated and the gear 28 is thereby rotated first in one direction through a predetermined arcuate extent and thereafter rotated in the opposite direction through the same predetermined arcuate extent.

Figure 5:
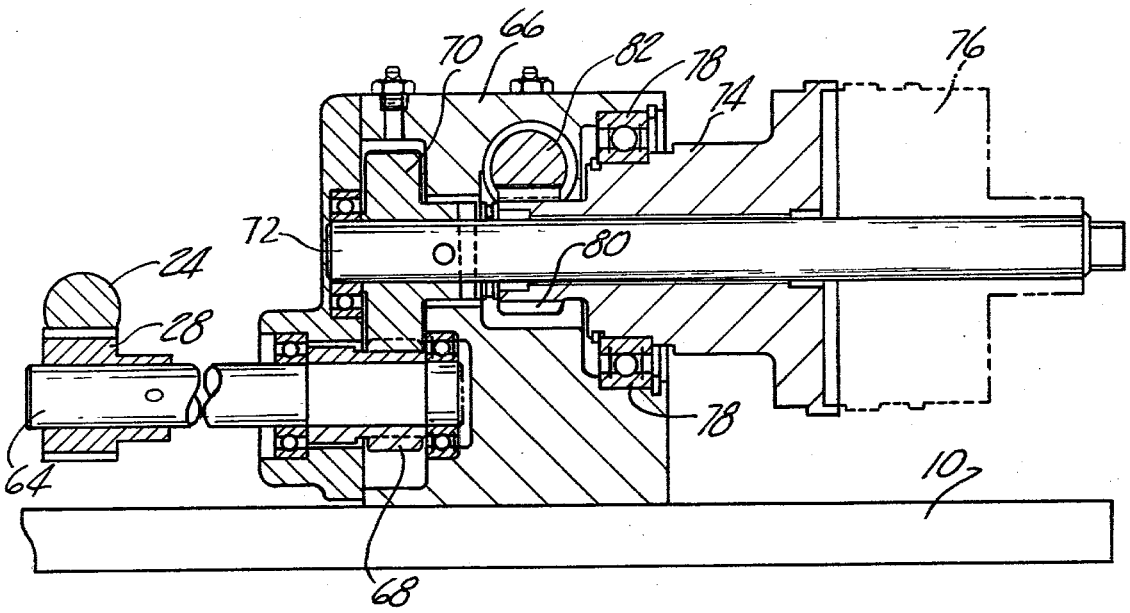
FIG. 5 is a sectional view along the line 5—5 in FIG. 1.

Referring to FIG. 5, the actuator drive gear 28 is pinned to a shaft 64 which extends into a housing 66. Within housing 66 there is keyed to shaft 64 a gear 68 which meshes with a gear 70 on a shaft 72. Shaft 72 is connected to a concentric sleeve 74 through an overload clutch 76. Sleeve 74 is journalled in housing 66 by bearings 78. Sleeve 74 is formed with a gear 80 which meshes with a gear rack portion formed on a horizontally reciprocable drive shaft 82.

The arrangement thus far described is substantially the same as that disclosed in my aforesaid U.S. Pat. No. 3,756,425. The present invention is directed primarily to the means employed for reciprocating drive shaft 82.

Figure 2:
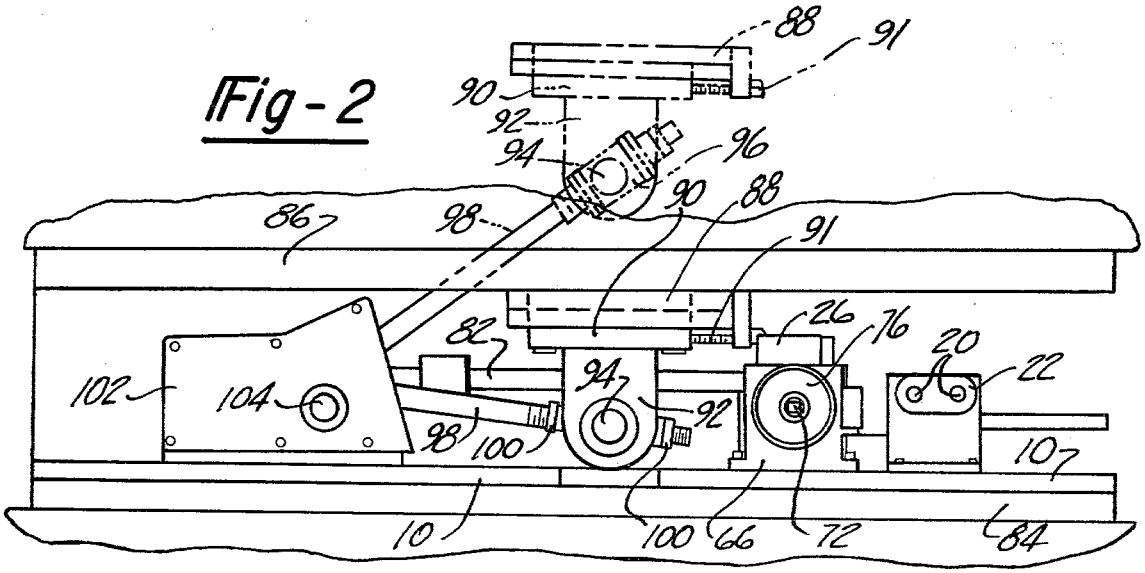
FIG. 2 is a fragmentary side elevational view of a press provided with a transfer device of the present invention.
Figure 3:
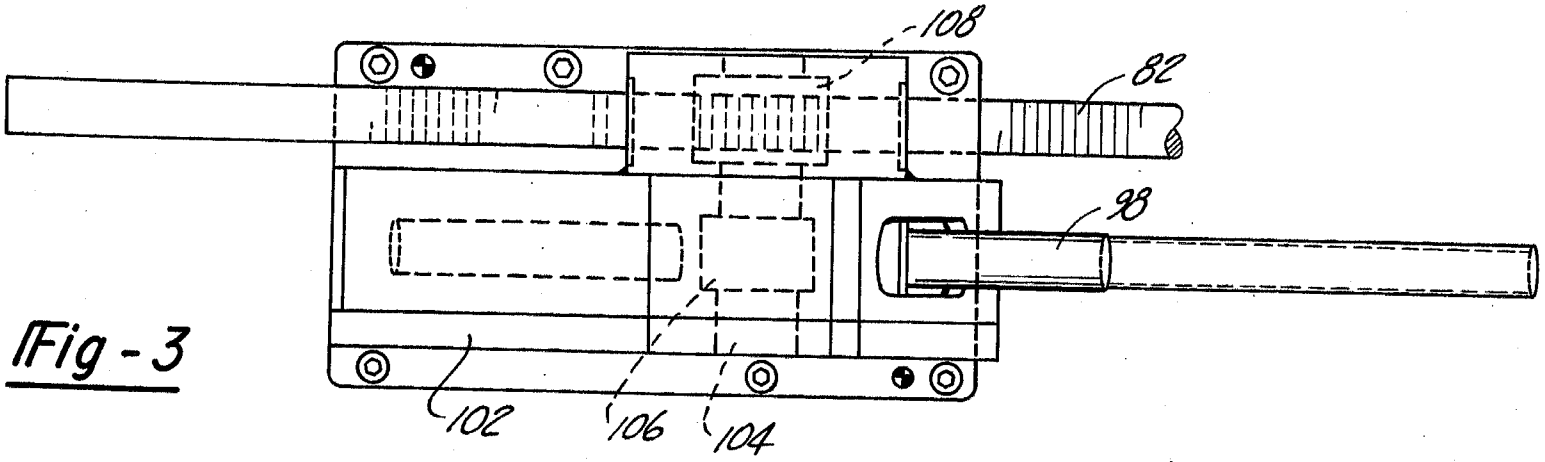
FIG. 3 is a top plan view of the gear rack drive.
Figure 4:
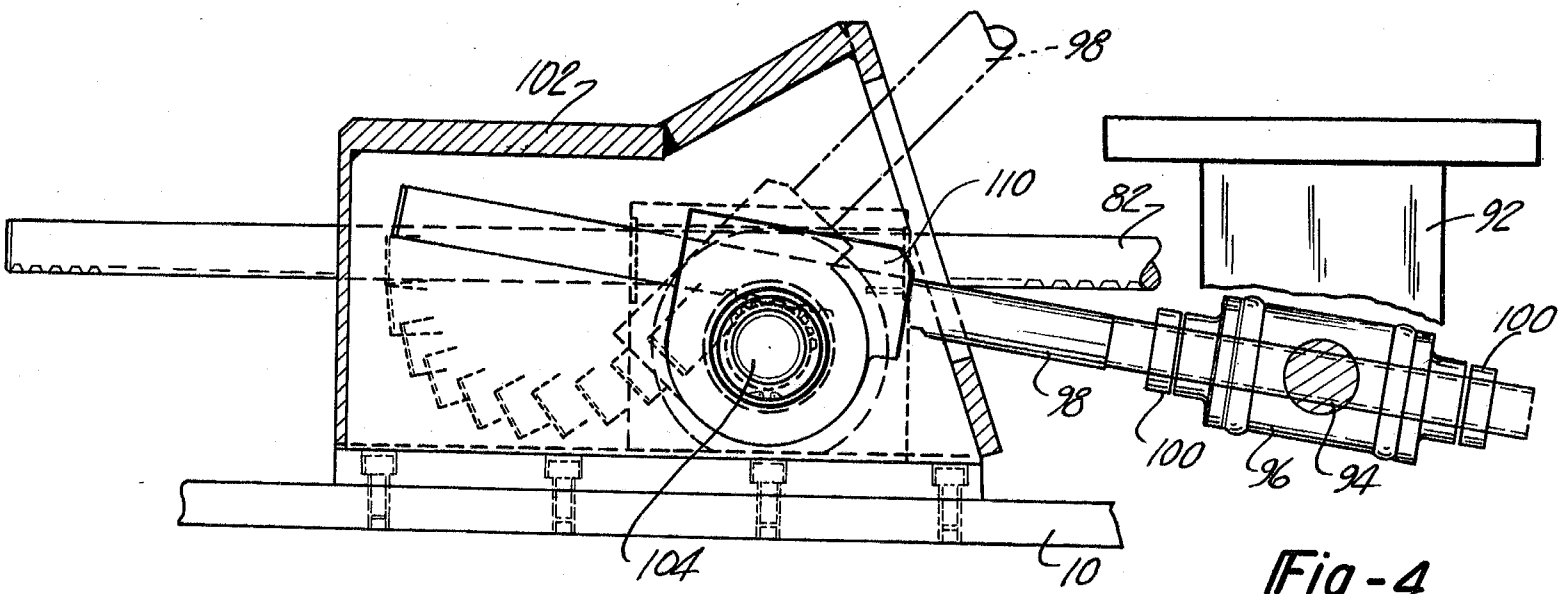
FIG. 4 is a side elevational view of the gear rack drive.

Referring now to FIG. 2, the lower die plate on which the base plate 10 of the transfer mechanism is mounted is designated 84 and the upper die plate attached to the reciprocating ram of the press is designated 86. A guide plate 88 is fixedly mounted on plate 86 and supports an adjustable shoe 90. Shoe 90 is adapted to be adjusted lengthwise of plate 88 by an adjusting screw 91. Shoe 90 supports a bearing block 92 on which a horizontally extending stub shaft 94 is journalled. At one end thereof shaft 94 is formed with a bearing sleeve 96 (FIG. 1), the axis of which extends perpendicular to the axis of shaft 94. A gear rack 98 extends through sleeve 96 and is secured thereto by a pair of clamping nuts 100. A housing 102 is mounted on base plate 10 at a location laterally offset from bearing block 92. Within housing 102 there is journalled on an axis parallel to the axis of shaft 94 a shaft 104 on which gears 106,108 (FIG. 3) are secured. Gear rack 98 is slidably received within a bearing sleeve 110 journalled on shaft 104. The teeth of gear rack 98 are maintained in mesh with the teeth of gear 106 by bearing sleeve 110. The reciprocating drive shaft 82 extends horizontally through housing 102 in engagement with the teeth of gear 108.

With the above described arrangement it will be appreciated that when the ram of the press moves downwardly from its raised position (shown in broken lines in FIG. 2) to its down position, gear rack 98 pivots about shaft 104 and simultaneously slides through bearing sleeve 110 to rotate gear 106 and gear 108. Thus, as the ram of the press reciprocates vertically the transfer mechanism operates through its complete cycle as previously described.

When it is desired to remove the transfer mechanism from the press and store is temporarily while a different workpiece is being produced on the press, it is merely necessary to detach plate 84 from the bed of the press and detach plate 86 from the press ram. Gear rack 98 is thus permitted to pivot downwardly to the solid line position shown in FIG. 2 and the whole unit is then removed from the press. This results in a very compact storage configuration for the entire transfer mechanism.

It will also be appreciated that the manner in which gear rack 98 is connected to the press ram permits any desired adjustment or timing of the transfer mechanism. For example, if it is desired to increase the stroke of actuator 24, shoe 90 is displaced to the left on plate 88 so that the lateral spacing between shafts 104 and 94 is smaller. Likewise, if it is desired to reduce the stroke of actuator 24, then screw 91 is adjusted to shift shoe 90 to the right and, thus, increase the lateral spacing between shafts 104 and 94. When it is desired to adjust the axial position of actuator 24 at the beginning or end of its stroke relative to the latch mechanisms 34,36, this can readily be accomplished by simply adjusting gear rack 98 lengthwise relative to its sleeve bearing 96. This adjustment might become necessary to obtain the proper operation of the latches 34,36 and can be accomplished by merely adjusting the clamping nuts 100 on the threaded end of gear rack 98.

I claim:

1. In a metal working press having a vertically reciprocable ram, a transfer device including a top plate adapted to be mounted on the press ram, a base adapted to be mounted on the press bed, a mechanism on said base for transferring workpieces between successive stations in the press and drive means for the transfer mechanism comprising a drive gear journalled on said base for operating the transfer mechanism when rotated in opposite directions and a gear rack mounted on said top plate for movement therewith and meshing with said drive gear, the improvement which comprises a first support on said top plate to which one end of the gear rack is pivotally connected, a pivotal support on said base slidably supporting said gear rack in meshing relation with said drive gear, the pivotal connection between the gear rack and the first support and the pivotal support on said base being laterally offset from one another so that when the ram is in raised position the gear rack is inclined downwardly at an angle to the vertical whereby, when the ram reciprocates, the gear rack pivots around and shifts axially relative to said pivotal support to rotate the drive gear.

2. The combination called for in claim 1 wherein the pivotal axis of the pivotal support is concentric with the axis of rotation of said drive gear.

3. The combination called for in claim 1 including means for shifting said pivotal connection laterally on said top plate toward and away from the pivotal support on said base.

4. The combination called for in claim 1 wherein said first support comprises a mounting plate fixedly mounted on said top plate, a shoe mounted on said mounting plate and to which one end of the gear rack is pivotally connected and means for adjusting the shoe on said mounting plate to vary the horizontal spacing between said pivotal connection and the pivotal axis of said pivotal support.

5. The combination called for in claim 1 wherein said first support comprises a bracket mounted on said top plate and means for adjustably displacing the bracket horizontally on said bracket to vary the horizontal spacing between said pivotal connection and the pivot axis of said pivotal support.

6. The combination called for in claims 1 or 2 including means for adjusting said gear rack axially relative to the pivotal axis of said pivotal connection.

7. The combination called for in claims 1 or 3 wherein said first support comprises a bracket mounted on said top plate, a shaft journalled on said bracket, means on said shaft supporting one end of the gear rack and means for adjusting the gear rack axially relative to the support means on the shaft.

8. The combination called for in claim 6 wherein said transfer mechanism includes a carriage shiftable in a rectilinear path on said base between an advanced and a retracted position, a finger bar mounted on said carriage for movement transversely of the path of travel of the carriage to grip and release workpieces and also for movement with the carriage to advance the workpieces to the next successive station, and an actuator shaft axially shiftable in a path parallel to the path of travel of the carriage and having a lost motion connection with the carriage such that during a portion of its stroke it shifts axially relative to the carriage and actuates the finger bar and during another portion of its stroke it displaces the carriage through the carriage stroke and means interconnecting said drive gear and actuator such as to displace the actuator axially in response to the rotation of said drive gear.

* * * * *